US005930897A

United States Patent [19]

Wentzek

[11] Patent Number: 5,930,897

[45] Date of Patent: Aug. 3, 1999

[54] METHOD AND APPARATUS FOR TEMPERING KNOTTED COIL SPRINGS

[75] Inventor: Horst F. Wentzek, Kenosha, Wis.

[73] Assignee: Frank L. Wells Company, Kenosha, Wis.

[21] Appl. No.: 09/013,419

[22] Filed: Jan. 26, 1998

Related U.S. Application Data

[60] Provisional application No. 60/057,213, Aug. 29, 1997.

[51] Int. Cl.[6] ..... B21F 35/02; C21D 1/06; B21K 29/00

[52] U.S. Cl. ..... 29/896.92; 29/564; 72/128; 140/364; 148/580; 148/908; 266/252

[58] Field of Search ..... 29/896.9, 896.92, 29/564; 140/36 A, 92.7; 148/580, 908; 266/249, 252; 72/128, 137

[56] References Cited

U.S. PATENT DOCUMENTS

| | | | |
|---|---|---|---|
| 3,343,573 | 9/1967 | Dillon | 29/896.9 |
| 4,111,241 | 9/1978 | Crown | 140/36 A |
| 4,609,185 | 9/1986 | Thoenen | 267/91 |

*Primary Examiner*—P. W. Echols
*Attorney, Agent, or Firm*—Michael Best & Friedrich LLP

[57] ABSTRACT

Disclosed herein is apparatus for fabricating a coil spring including axially opposite end convolutions having respective ends respectively knotted to the associated end convolutions, which apparatus comprises a frame, a coil forming device mounted on the frame and operative to initially form a coil spring including axially opposite end convolutions having respective free ends, a tempering device mounted on the frame and operative to temper the initially formed coil spring, a knotting mechanism mounted on the frame and operative to respectively knot the free ends of the tempered coil spring to the associated end convolutions, and a transport mechanism mounted on the frame and operative to transport the initially formed coil spring to the tempering device, and to transport the tempered coil spring to the knotting mechanism. Also disclosed herein is a method of fabricating a coil spring including an end convolution having an end knotted to the end convolution, which method comprises steps of initially forming a coil spring including an end convolution having a free end, tempering the initially formed coil spring, and knotting the free end of the initially formed and tempered coil spring to the end convolution.

14 Claims, 2 Drawing Sheets

METHOD AND APPARATUS FOR TEMPERING KNOTTED COIL SPRINGS

RELATED APPLICATION

Attention is directed to U.S. Provisional patent application Ser. No. 60/057,213, filed Aug. 29, 1997, and entitled Coil Spring Forming and Conveying Assembly, which provisional application is incorporated herein by reference.

BACKGROUND OF THE INVENTION

The invention relates generally to apparatus and methods for forming knotted coil springs. In the past, in the manufacture of knotted coil springs, the wire of the coil springs was tempered, if at all, either after the knotting, or after the knotting and subsequent integration into a spring assembly.

Also in the past, the Assignee of this application has sold, for more than one year prior to this application, a coil spring forming, knotting, and tempering machine as shown in the attached brochure filed herewith. The tempering took place after the knotting.

Also in the past, coil springs including end convolutions with parallel portions, such as the central arms 18 shown in U.S. Pat. No. 4,609,186, were initially partially formed by a coil spring forming head or device, were then tempered, and were then formed to include the parallel portions.

SUMMARY OF THE INVENTION

The invention provides apparatus for fabricating a coil spring including an end convolution having an end knotted to the end convolution, which apparatus comprises a coil spring former operative to initially form a coil spring including an end convolution having a free end, a tempering device operative to temper the initially formed coil spring, a knotting mechanism operative to knot the free end of the tempered coil spring to the end convolution, and a transfer mechanism operative to transport the initially formed coil spring from the coil former to the tempering device and to transport the tempered coil spring from the tempering device to the knotting mechanism.

The invention also provides apparatus for fabricating a coil spring including axially opposite end convolutions having respective ends respectively knotted to the associated end convolutions, which apparatus comprises a frame, a coil spring forming device mounted on the frame and operative to initially form a coil spring including axially opposite end convolutions having respective free ends, a tempering device mounted on the frame and operative to temper the initially formed coil spring, a knotting mechanism mounted on the frame and operative to respectively knot the free ends of the tempered coil spring to the associated end convolutions, a stacking station mounted on the frame and operative to retain tempered and knotted coil springs, and a transport mechanism mounted on the frame and operative to transport the initially formed coil spring from the coil spring forming device to the tempering device, to transport the tempered coil spring from the tempering device to the knotting mechanism, and to transport the tempered and knotted coil spring from the knotting mechanism to the stacking station.

The invention also provides apparatus for fabricating a coil spring including axially opposite end convolutions having respective ends respectively knotted to the associated end convolutions, which apparatus comprises a frame, a coil spring forming device mounted on the frame and operative to initially form a coil spring including axially opposite end convolutions having respective free ends, a tempering device mounted on the frame and operative to temper the initially formed coil spring, a knotting mechanism mounted on the frame and operative to respectively knot the free ends of the tempered coil spring to the associated end convolutions, a loading station adjacent the frame and operative to deliver tempered and knotted coil springs to a transfer conveyor for delivery to a spring assembly machine, and a transport mechanism operative to transport the initially formed coil spring from the coil spring forming device to the tempering device, to transport the tempered coil spring from the tempering device to the knotting mechanism, and to transport the tempered and knotted coil spring from the knotting mechanism to the loading station.

The invention also provides a method of fabricating a coil spring including an end convolution having an end knotted to the end convolution, which method comprises the steps of initially forming a coil spring including an end convolution having a free end, tempering the initially formed coil spring, and knotting the free end of the initially formed and tempered coil spring to the end convolution.

The invention also provides a method of fabricating a coil spring including axially opposite end convolutions having respective ends respectively knotted to the associated end convolutions, the method comprising the steps of operating a coil spring forming device to initially form a coil spring including axially opposite end convolutions having respective free ends, transporting the initially formed coil spring from the coil spring forming device to a coil spring tempering device, operating the coil spring tempering device to temper the initially formed coil spring, transporting the initially formed and tempered coil spring from the coil spring tempering device to a knotting device, operating the knotting device to respectively knot the free ends to the associated end convolutions, and transporting the initially formed, tempered, and knotted coil spring from the knotting device to a coil spring retaining station.

The invention also provides a method of fabricating a coil spring including axially opposite end convolutions having respective ends respectively knotted to the associated end convolutions, which method comprises the steps of operating a coil spring forming device to initially form a coil spring including axially opposite end convolutions having respective free ends, transporting the initially formed coil spring from the coil spring forming device to a coil spring tempering device, operating the coil spring tempering device to temper the initially formed coil spring, transporting the initially formed and tempered coil spring from the coil spring tempering device to a knotting device, operating the knotting device to respectively knot the free ends to the associated end convolutions, and transporting the tempered and knotted coil spring from the knotting device to a station for loading the coil spring on a conveyor for transport for further assembly.

Other features and advantages of the invention will become apparent to those skilled in the art upon review of the following detailed description, claims and drawings.

Figure 1:
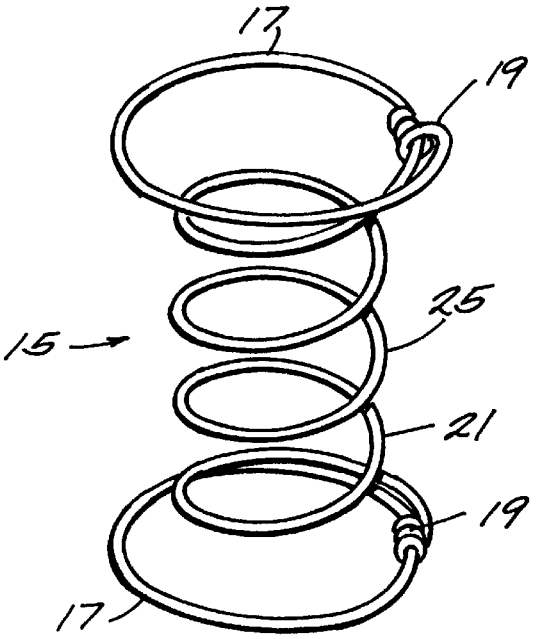
FIG. 1 is a perspective view of a knotted coil spring fabricated by coil spring fabricating machines or apparatus which embody various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Figure 3:
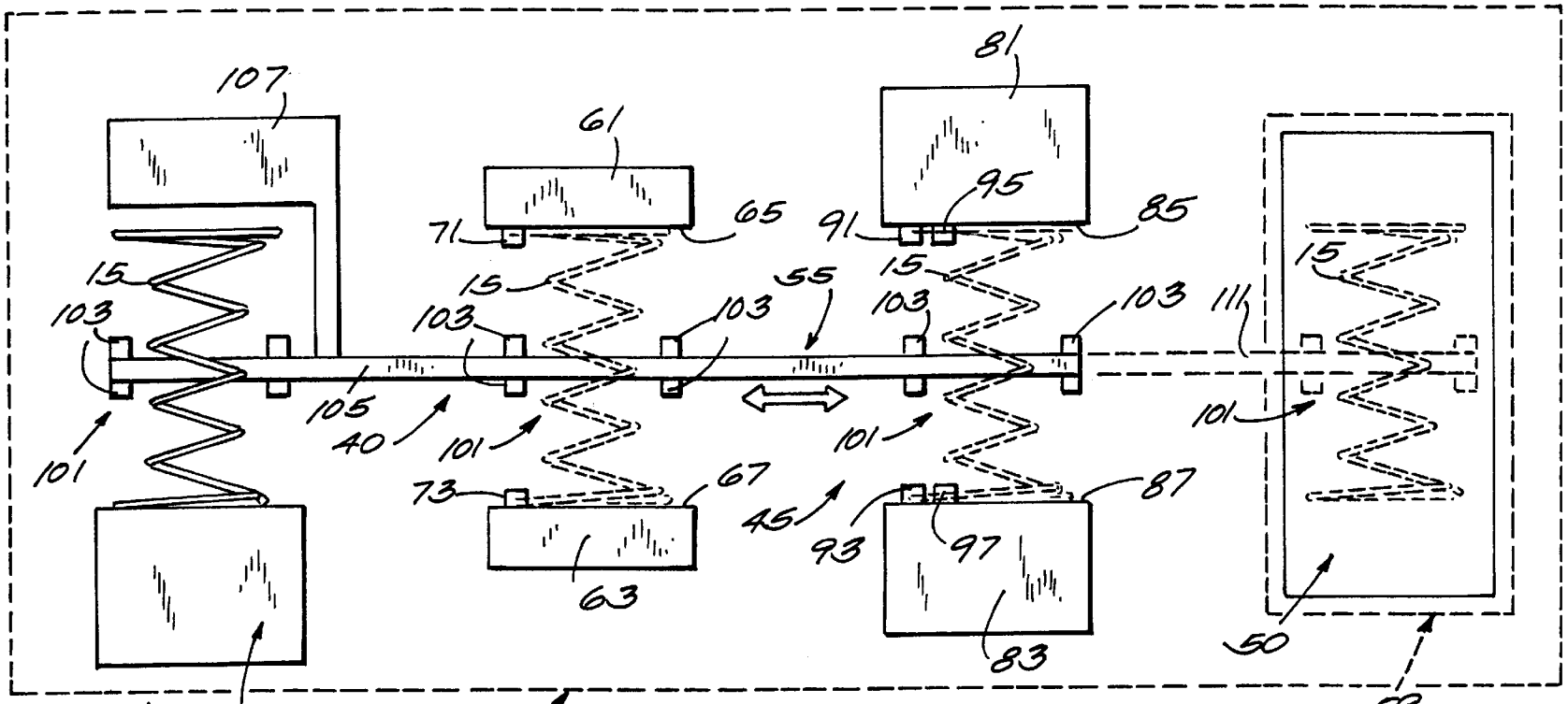
FIG. 3 is a diagrammatic view of a coil spring fabricating machine which embodies various of the features of the invention and which is operative to produce the coil spring shown in FIG. 1 in accordance with method(s) embodying various of the features of the invention.

Shown in FIG. 3 of the drawings is a machine or apparatus 11 for forming or fabricating a knotted coil spring 15 such as shown in FIG. 1.

The coil spring 15 is formed of steel wire and comprises axially spaced opposite generally circular end convolutions 17 having generally identical diameters and including respective terminals ends knotted, as indicated at 19, to the associated end convolution. The coil spring 15 also includes a spiraled portion 21 extending between the end convolutions 17 and including a central or intermediate part 25 having a diameter less than the diameter of the end convolutions 17.

The coil spring fabricating machine or apparatus 11 shown in FIG. 3 generally includes a supporting frame 31 which can be of any suitable construction. The coil spring fabricating machine or apparatus 11 also includes a schematically illustrated coil spring forming device, or forming head, or station 35 operative to initially form the coil spring 15 including the axially opposite end convolutions 17 which, as initially formed, include respective free ends. The coil spring fabricating machine or apparatus 11 also includes a schematically illustrated tempering device or station 40 which is operative to temper the initially formed coil spring. In addition the coil spring fabricating machine or apparatus 11 also includes a schematically illustrated knotting mechanism, or device, or station 45 which is operative to respectively knot the free ends of the tempered coil spring to the associated end convolutions. Still further in addition, the coil spring fabricating machine or apparatus 11 also includes a schematically illustrated stacking station or coil spring retaining station 50 which is operative to retain tempered and knotted coil springs, and a schematically illustrated transport or transfer mechanism 55 which is operative to transport the initially formed coil springs to the tempering device or station 40, to transport the tempered coil springs to the knotting mechanism or station 45, and to transport the tempered and knotted coil springs to the stacking station or 50 device (or in the alternative, to a loading station 59 which is shown in dotted outline in FIG. 3 and at which the fully formed and tempered coil spring is delivered to a transfer conveyor (not shown), such as indicated by the numeral 121 in copending Provisional patent application Ser. No. 60/057,213, filed Aug. 29, 1997).

Figure 2:
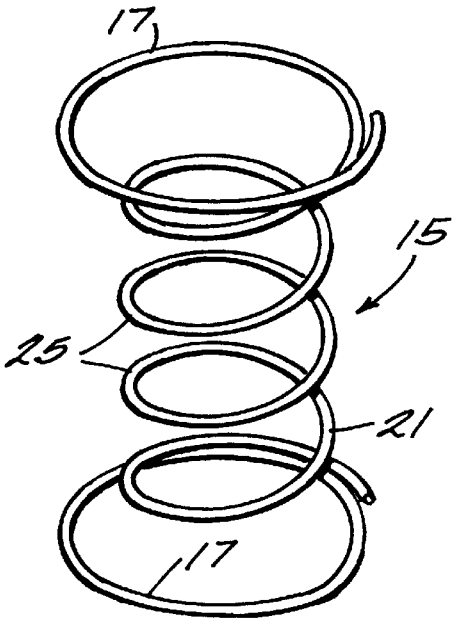
FIG. 2 is a perspective view of a partially formed, unknotted coil spring prior to tempering and knotting thereof.

More particularly, the coil spring forming device or forming head 35 is suitably mounted on the supporting frame 31, can be of any suitable construction, such as disclosed in U.S. Provisional patent application Ser. No. 60/057,213, filed Aug. 29, 1997, and is operable, as indicated, to feed suitable wire from a suitable feed-coil (not shown), to bend the wire in such manner as to partially produce the coil spring 15, as shown in FIG. 2, by forming the spiral portion 21 and the end convolutions 17 with respective unknotted or free ends, to deliver the partially formed coil spring into a position in outstanding relation to the forming machine or head 35, and to cut or sever the wire subsequent to gripping of the central or intermediate part 25 by the transport or transfer mechanism 55. One such suitable spring forming device, operative as explained above, has been on sale by the assignee of this application for more than one year prior to the filing of this application.

The coil spring tempering device or station 40 is mounted on the frame 31, in spaced relation to the coil spring forming head 35, and can be of any suitable construction. The tempering device or station 40 includes opposed separate portions 61 and 63 which are spaced at approximately the axial height of the coil spring 15, i.e., at a distance generally about the same as the distance between the outside surfaces of the end convolutions 17 of the coil spring 15. The tempering device or station 40 also includes schematically illustrated generally, spaced and parallel electrically insulated facing surfaces 65 and 67, one for each portion 61 and 63, between which the coil springs are located, one at a time, by the transport or transfer mechanism 55, preferably with the end convolutions 17 of the coil springs in closely adjacent or touching engagement with the facing surfaces 65 and 67.

In addition, the tempering device or station 40 also includes schematically illustrated, opposed clamping or gripping devices 71 and 73, one for each portion 61 and 63, for realeasably gripping the end convolutions 17 of the coil spring located between the facing surfaces 65 and 67, preferably adjacent the unknotted or free ends thereof, and for applying electrical current through the thusly located and gripped coil spring to effect tempering thereof. One such tempering device, operative as explained above, has been on sale by the assignee of this application for more than one year prior to the filing of this application.

The knotting mechanism or station 45 can be of any suitable construction, is mounted on the frame 31 in spaced relation from the tempering device or station 40 on the far side from the coil spring forming device or head 35, and at the same spacing as the spacing between the coil spring forming device or head 35 and the tempering device or station 40. The knotting mechanism or station 45 includes schematically illustrated, opposed and spaced, simultaneously operating knotting devices 81 and 83, one for each of the free ends of the end convolutions 17, which knotting devices 81 and 83 can be of any suitable construction, are respectively mounted on the frame 31, and respectively include generally parallel facing surfaces 85 and 87 which are spaced at approximately the axial height of the coil spring 15 and which receive therebetween the coil springs which are located, one at a time, by the transport or transfer mechanism 55, preferably with the end convolutions 17 in closely adjacent or touching engagement with the opposed facing surfaces 85 and 87.

The knotting devices 81 and 83 each also include schematically illustrated, clamping or gripping devices 91 and 93 for releasably holding the end convolutions 17, together with respective schematically illustrated, wire bendings mechanisms 95 and 97 operable, when the end convolutions 17 are gripped or clamped, for twisting the unknotted or free ends of the end convolutions 17 around portions of the associated end convolutions spaced from the unknotted free ends to form the knots 19. One such knotting mechanism including a pair of spaced and opposed knotting devices, operative as explained above, has been on sale by the assignee of this application for more than one year prior to the filing of this application.

The stacking device or coil spring retaining station 50 can also be of any suitable construction and can also be mounted on the frame 31. The stacking device or station 50 is generally operative to receive and store the knotted coil springs until future assembly in a spring assembly.

The transport or transfer mechanism 55 is also mounted on the frame 31 and, in operation, the transport or transfer mechanism 55 operates to releasably grip a partially formed spring coil upon emergence from the coil spring forming head 35. After such gripping, the coil spring forming device or head 35 operates to sever the wire, thereby disconnecting the partially formed coil from the feed-wire. Thereafter, the transport mechanism 55 transports the partially formed coil spring to the tempering device or station 40 where the coil spring is gripped by the tempering device 40, as noted above, after which the grip of the transport device 55 is released so that the coil spring is thereafter only held by the tempering station 40 during the tempering operation.

At the same time that the transport or transfer mechanism 55 is transporting the just mentioned partially formed coil spring from the coil spring forming head 35 to the tempering device 40, the transport or transfer mechanism 55 also simultaneously operates to releasably grip another previously tempered coil spring which is located in the tempering device or station 40. Thereafter, the tempering device or station 40 releases the grip on the partially formed and tempered coil spring and the transport mechanism 55 operates to thereafter transport the previously tempered coil spring from the tempering station 40 to the knotting mechanism or station 45. After gripping of the partially formed and tempered coil spring by the knotting mechanism or station 45, the transport mechanism 55 releases the transported coil spring.

Also at the same time that the transport mechanism 55 is transporting the partially formed coil spring from the coil spring forming device or head 35 to the tempering device or station 40, and is transporting the previously tempered coil spring from the tempering device or station 40 to the knotting mechanism or station 45, and prior to release of the tempered and knotted-coil spring by the knotting mechanism 45, the transport or transfer mechanism 55 grips the tempered and knotted coil spring. Thereafter, the knotting mechanism or station 45 releases the tempered and knotted coil spring and the transport mechanism operates to transport the tempered and knotted coil spring from the knotting mechanism or station 45 to the stacking station 50, or, in the alternative construction, to the loading station 59.

The transport or transfer mechanism 55 can be of any suitable construction and includes three schematically illustrated claw or clamping assemblies 101 which are operable in first positions, to realeasably clamp, grip, or hold the central or intermediate parts 25 of the coil springs at the coil spring forming head 35, at the tempering station 40, and at the knotting mechanism or station 45, and to unclamp or release the gripped coil springs after respective transport of the gripped coil springs to respective second positions at the tempering station 40, the knotting station 45, and the stacking station 50 or, in the alternative, the loading station 59. As already indicated, the release of the gripped coil springs by the claw assemblies 101 at the tempering station 40 and at the knotting station 45 occurs only after clamping or gripping by the tempering station 40 and the knotting station 45 of the arriving coil springs. Each of the claw or clamp assemblies 101 includes a suitable pair of clamping jaws 103 adapted to grip and hold the coil springs. In addition, the three claw or clamping assemblies 103 are connected for common travel by a schematically illustrated sub-frame 105 which can be of any suitable construction.

The transport or transfer mechanism 55 also includes any suitable (schematically illustrated) means 107 for reciprocably displacing the sub frame 105 and connected claw assemblies 101 between the first and second positions described above and through a predetermined path 111 having a predetermined length equal to the spacing between the coil spring forming head 35 and the tempering station 40, which spacing is the same as the spacing between the tempering station 40 and the knotting station 45 and the spacing between the knotting station 45 and the stacking station 50 (or loading station 59). Such displacing means 107 includes suitable means (not shown) for moving the sub frame 105 and connected claw assemblies 101 along the path 111 of travel. The path 111 of travel can be either linear or arcuate and any suitable arrangement can be employed for powering reciprocating travel of the sub frame 105 and connected claw assemblies 101 along the path 111 of travel and for operating the claw assemblies 101 to grip and release the coil springs.

Figure 4:
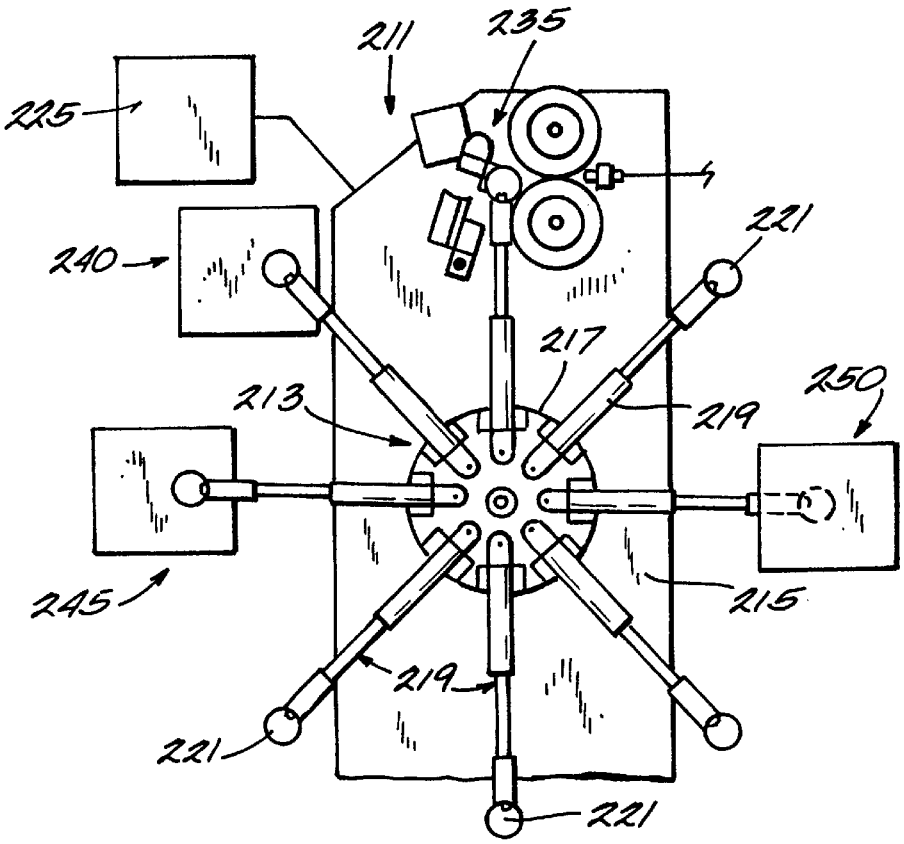
FIG. 4 is a partially diagrammatic view of another coil spring fabricating machine which embodies various of the features of the invention and which is operative to produce the coil spring shown in FIG. 1 in accordance with method (s) embodying various of the features of the invention.

Shown in FIG. 4 of the drawings is another machine or apparatus 211 for forming or fabricating a knotted coil spring 15 such as shown in FIG. 1. The fabricating machine 211 includes a rotating spoke assembly 213 which can be of any suitable construction, which is rotatably mounted on a schematically illustrated, suitable frame 215, and which includes a hub 217, and a plurality of spokes or arms 219 which extend from the hub 217, which are suitably electrically insulated from the hub 217, and which respectively include, at the outer ends thereof, a schematically illustrated, releasable gripping mechanism 221 which can be of any suitable construction. The spoke assembly 291 is, upon each energization of a drive servo-motor 225, incrementally rotated through a given arcuate distance in such manner as to locate one of the spokes or arms 219 and associated gripping mechanism 221 in position adjacent to a coil spring forming head 235 which is suitably mounted on the frame 215 and which can be of any suitable construction. When at the coil spring forming head 235, the adjacent gripping mechanism 221 acts to releaseably grasp a partially formed coil spring as the partially formed coil spring exits the coil spring forming head 235. After gripping by the gripping mechanism 221, the wire exiting the coil spring forming head 235 is severed or cut by the coil spring forming head 235.

Thereafter, the spoke assembly 213 incrementally rotates through the given arcuate distance in response to the next energization of the drive servo-motor 225 so as to move the gripped partially formed coil spring to a tempering station 240 which is suitably mounted on the frame 215, which is operative to temper the gripped coil spring, and which can be of any suitable construction. After gripping of the partially formed coil spring by the tempering device or station 240, the grip of the coil spring by the gripping mechanism 221 is released and the coil spring is tempered.

Thereafter, when the drive servo-motor 225 is again energized, the applicable gripping mechanism 221 of the spoke assembly 213 grips the tempered coil spring and the grip of the tempered coil spring by the tempering device or station 240 is released. After such release, the spoke assembly 213 is again incrementally rotated by the servo-motor 225 though the given arcuate distance to deliver the gripped and tempered coil spring to a knotting mechanism 245 which is suitably mounted on the frame 215, which is operative to knot the free or unknotted ends of the tempered coil spring, and which can be of any suitable construction. After gripping of the partially formed coil spring by the knotting mechanism or station 245, the grip of the coil spring by the applicable gripping mechanism 221 is released and the knotting mechanism or station 245 acts to form the knots 19.

Thereafter, the knotted coil spring is gripped by the applicable gripping mechanism 221 and, subsequently, the grip by the knotting mechanism 245 of the knotted coil spring is released. The spoke assembly 213 is then again energized by the servo-motor 225 to incrementally rotate the arms 219 through the given arcuate distance so as to transport or move the gripped, tempered and knotted coil spring to a loading station 250 (or to a stacking station-not shown) which can be of any suitable construction and wherein the coil spring is delivered to a transfer conveyor (not shown), such as indicated by the numeral 121 in copending Provisional patent application Ser. No. 60/057, 213, filed Aug. 29, 1997. Upon delivery of the coil spring to the loading station 250, the coil spring is released by the applicable gripping mechanism 221.

The above descriptions of the coil spring forming apparatus 11 and 211 amply describe the operation of the method(s) of the invention.

The above described apparatus 11 and 211 and method(s) permit more accurate location of the knots 19 on the end convolutions 17 of the thusly formed coil springs 15 due to the occurrence of tempering prior to knotting as compared to the prior art wherein, to Applicants' knowledge, knotted coils were always tempered, if at all, after knotting and not before knotting as disclosed herein. Such prior methods of knotting and then tempering resulted in unreliable location of the knots relative to the remainder of the coil springs due to variations in the carbon content of the wire being formed into coil springs.

Various of the features are set forth in the following claims.

I claim:

1. Apparatus for fabricating a coil spring including an end convolution having an end knotted to the end convolution, said apparatus comprising a coil spring former operative to initially form a coil spring including an end convolution having a free end, a tempering device operative to temper the initially formed coil spring, a knotting mechanism operative to knot the free end of the tempered coil spring to the end convolution, and a transfer mechanism operative to transport the initially formed coil spring from the coil spring former to the tempering device and to transport the tempered coil spring from the tempering device to the knotting mechanism.

2. Apparatus for fabricating a coil spring including axially opposite end convolutions having respective ends respectively knotted to the associated end convolutions, said apparatus comprising a frame, a coil spring forming device mounted on said frame and operative to initially form a coil spring including axially opposite end convolutions having respective free ends, a tempering device mounted on said frame and operative to temper the initially formed coil spring, a knotting mechanism mounted on said frame and operative to respectively knot the free ends of the tempered coil spring to the associated end convolutions, a stacking station mounted on said frame and operative to retain tempered and knotted coil springs, and a transport mechanism mounted on said frame and operative to transport the initially formed coil spring from said coil spring forming device to said tempering device, to transport the tempered coil spring from said tempering device to said knotting mechanism, and to transport the tempered and knotted coil spring from said knotting mechanism to said stacking station.

3. A coil spring fabricating apparatus in accordance with claim 2 wherein said knotting mechanism includes two knotting devices respectively operative to knot a different one of the coil spring ends.

4. A coil spring fabricating apparatus in accordance with claim 2 wherein said transport mechanism carries the coil springs in an arcuate path from said coil forming device to said stacking station.

5. A coil spring fabricating apparatus in accordance with claim 2 wherein said transport mechanism carries the coil springs in a linear path from said coil forming device to said stacking station.

6. A coil spring fabricating apparatus in accordance with claim 2 wherein said transport mechanism includes a subframe, first, second, and third clamping assemblies mounted on said sub frame and respectively adapted to releasably clamp a coil spring, and means for displacing said sub frame between a first position wherein said first, second, and third clamping assemblies are respectively located at said coil forming head, at said tempering device, and at said knotting mechanism, and a second position wherein said clamping assemblies are respectively located at said tempering device, at said knotting mechanism, and at said loading station.

7. Apparatus for fabricating a coil spring including axially opposite end convolutions having respective ends respectively knotted to the associated end convolutions, said apparatus comprising a frame, a coil spring forming device mounted on said frame and operative to initially form a coil spring including axially opposite end convolutions having respective free ends, a tempering device mounted on said frame and operative to temper the initially formed coil spring, a knotting mechanism mounted on said frame and operative to respectively knot the free ends of the tempered coil spring to the associated end convolutions, a loading station adjacent said frame and operative to deliver tempered and knotted coil springs to a transfer conveyor for delivery to a spring assembly machine, and a transport mechanism operative to transport the initially formed coil spring from said coil spring forming device to said tempering device, to transport the tempered coil spring from said tempering station to said knotting mechanism, and to transport the tempered and knotted coil spring from said knotting mechanism to the loading station.

8. A coil spring fabricating apparatus in accordance with claim 7 wherein said knotting mechanism includes two knotting devices respectively operative to knot a different one of the coil spring ends.

9. A coil spring fabricating apparatus in accordance with claim 7 wherein said transport mechanism carries the coil springs in an arcuate path from said coil forming device to said stacking station.

10. A coil spring fabricating apparatus in accordance with claim 7 wherein said transport mechanism carries the coil springs in a linear path from said coil forming device to said stacking station.

11. A coil spring fabricating apparatus in accordance with claim 7 wherein said transport mechanism includes a subframe, first, second, and third clamping assemblies mounted on said sub frame and respectively adapted to releasably clamp a coil spring, and means for displacing said sub frame between a first position wherein said first, second, and third clamping assemblies are respectively located at said coil forming head, at said tempering device, and at said knotting mechanism, and a second position wherein said clamping assemblies are respectively located at said tempering device, at said knotting mechanism, and at said loading station.

12. A method of fabricating a coil spring including an end convolution having an end knotted to the end convolution, said method comprising the steps of initially forming a coil spring including an end convolution having a free end, tempering the initially formed coil spring, and knotting the free end of the initially formed and tempered coil spring to the end convolution.

13. A method of fabricating a coil spring including axially opposite end convolutions having respective ends respectively knotted to the associated end convolutions, said method comprising the steps of operating a coil spring forming device to initially form a coil spring including axially opposite end convolutions having respective free ends, transporting the initially formed coil spring from the coil spring forming device to a coil spring tempering device, operating the coil spring tempering device to temper the initially formed coil spring, transporting the initially formed and tempered coil spring from the coil spring tempering device to a knotting device, operating the knotting device to respectively knot the free ends to the associated end convolutions, and transporting the initially formed, tempered, and knotted coil spring from the knotting device to a coil spring retaining station.

14. A method of fabricating a coil spring including axially opposite end convolutions having respective ends respectively knotted to the associated end convolutions, said method comprising the steps of operating a coil spring forming device to initially form a coil spring including axially opposite end convolutions having respective free ends, transporting the initially formed coil spring from the coil spring forming device to a coil spring tempering device, operating the coil spring tempering device to temper the initially formed coil spring, transporting the initially formed and tempered coil spring from the coil spring tempering device to a knotting device, operating the knotting device to respectively knot the free ends to the associated end convolutions, and transporting the tempered and knotted coil spring from the knotting device to a station for loading the coil spring on a conveyor for transport for further assembly.

* * * * *